US011346081B2

(12) United States Patent
Yamashita et al.

(10) Patent No.: US 11,346,081 B2
(45) Date of Patent: May 31, 2022

(54) CONSTRUCTION MACHINE

(71) Applicant: Hitachi Construction Machinery Co., Ltd., Tokyo (JP)

(72) Inventors: Ryohei Yamashita, Tsuchiura (JP); Kazushige Mori, Tsuchiura (JP); Shinya Imura, Toride (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 308 days.

(21) Appl. No.: 16/489,437

(22) PCT Filed: Mar. 15, 2018

(86) PCT No.: PCT/JP2018/010352

§ 371 (c)(1),
(2) Date: Aug. 28, 2019

(87) PCT Pub. No.: WO2019/176076

PCT Pub. Date: Sep. 19, 2019

(65) Prior Publication Data

US 2021/0332564 A1 Oct. 28, 2021

(51) Int. Cl.

| | |
|---|---|
| ***E02F 9/22*** | (2006.01) |
| ***F15B 11/16*** | (2006.01) |
| ***F15B 15/20*** | (2006.01) |

(52) U.S. Cl.

CPC ..... *E02F 9/2235* (2013.01); *E02F 9/2296* (2013.01); *F15B 11/165* (2013.01);
(Continued)

(58) Field of Classification Search

CPC ..... E02F 9/2235; E02F 9/2285; E02F 9/2296; F15B 11/165; F15B 11/167

See application file for complete search history.

(56) References Cited

U.S. PATENT DOCUMENTS 5,056,312 A * 10/1991 Hirata ..... F15B 11/163 60/426
5,447,027 A 9/1995 Ishikawa et al.
(Continued)

FOREIGN PATENT DOCUMENTS

JP 7-119709 A 5/1995
JP 2013-543086 A 11/2013
(Continued)

OTHER PUBLICATIONS

English translation of document C1 (Japanese-language International Search Report (PCT/ISA/210) previously filed on Aug. 28, 2018) issued in PCT Application No. PCT/JP2018/010352 dated Jun. 19, 2018 (one (1) pages).
(Continued)

*Primary Examiner* — Kenneth Bomberg
*Assistant Examiner* — Matthew Wiblin
(74) *Attorney, Agent, or Firm* — Crowell & Moring LLP

(57) ABSTRACT

Provided is a construction machine capable of driving each hydraulic actuator at a suitable speed while suppressing delivery flow rate of a hydraulic pump, both at a single operation time of driving each hydraulic actuator respectively singularly and at a combined operation time of simultaneously driving a plurality of hydraulic actuators. A controller is configure to compute a first required pump flow rate for each of operation amounts of a plurality of operation devices, compute a second required pump flow rate greater than the first required pump flow rate for the same operation amount for each of the operation amounts of the plurality of operation devices, select as a final required pump flow rate either smaller one of a sum total value of the first required pump flow rates computed for the operation amounts of the plurality of operation devices and a maximum value of the second required pump flow rates computed for the operation
(Continued)

amounts of the plurality of operation devices, and control a regulator in such a manner that the delivery flow rate of the hydraulic pump and the final required pump flow rate will be equal.

3 Claims, 7 Drawing Sheets

(52) U.S. Cl.
CPC ..... *F15B 11/167* (2013.01); *F15B 15/20* (2013.01); *E02F 9/2285* (2013.01)

(56) References Cited

U.S. PATENT DOCUMENTS

| | | | | |
|---|---|---|---|---|
| 6,308,516 | B1 * | 10/2001 | Kamada | E02F 9/2228 60/450 |
| 2013/0160439 | A1 | 6/2013 | Lee et al. | |
| 2017/0009424 | A1 * | 1/2017 | Moriki | E02F 3/422 |
| 2018/0372131 | A1 * | 12/2018 | Werner | E02F 9/2296 |

FOREIGN PATENT DOCUMENTS

| | | | |
|---|---|---|---|
| JP | 2015-36495 | A | 2/2015 |
| KR | 0145144 | B1 | 4/1998 |

OTHER PUBLICATIONS

International Preliminary Report on Patentability (PCT/IB/338 & PCT/IB/373) issued in PCT Application No. PCT/JP2018/010352 dated Sep. 24, 2020, including English translation of document C2 (Japanese-language Written Opinion (PCT/ISA/237) previously filed on Aug. 28, 2019) (eight (8) pages).

Korean-language Office Action issued in Korean Application No. 10-2019-7024495 dated Oct. 5, 2020 with English translation (10 pages).

International Search Report (PCT/ISA/210) issued in PCT Application No. PCT/JP2018/010352 dated Jun. 19, 2018 (three pages).

Japanese-language Written Opinion (PCT/ISA/237) issued in PCT Application No. PCT/JP2018/010352 dated Jun. 19, 2018 (four pages).

* cited by examiner

CONSTRUCTION MACHINE

TECHNICAL FIELD

The present invention relates to a construction machine such as a hydraulic excavator, particularly to a construction machine on which is mounted a hydraulic drive system for driving a plurality of hydraulic actuators by a hydraulic pump of variable displacement type.

BACKGROUND ART

In general, a construction machine such as a hydraulic excavator includes a hydraulic pump, hydraulic actuators driven by a hydraulic fluid delivered from the hydraulic pump, and flow control valves that control supply and discharge of the hydraulic fluid to and from the hydraulic actuators. As a document disclosing the prior art of a hydraulic pump control system for controlling the flow rate of a hydraulic pump that drives a plurality of hydraulic actuators, there is, for example, Patent Document 1.

Patent Document 1 describes a hydraulic pump control system including a variable displacement hydraulic pump, a displacement varying mechanism for the variable displacement hydraulic pump, a regulator that controls the tilting amount of the displacement varying mechanism, a plurality of hydraulic actuators driven by the hydraulic pump, and control valves that control the driving of the hydraulic actuators. The hydraulic pump control system is provided with operation amount sensors that detect operation amounts of the control valves, and a controller in which tilting amounts for the displacement varying mechanism according respectively to the operation amounts detected by the operation amount sensors and maximum tilting amounts optimum for the hydraulic actuators corresponding respectively to these tilting amounts are set, to which the detected values at the operation amount sensors are inputted, and which outputs the tilting amounts according to these detected values to thereby control the regulator. The controller includes extraction means that are provided on the basis of each hydraulic actuator and that extract the tilting amounts according to the detected values at the operation amount sensors, and maximum value selecting means that selects a maximum value of the tilting amounts extracted by the extraction means.

PRIOR ART DOCUMENT

Patent Document

Patent Document 1: JP-1995-119709-A

SUMMARY OF THE INVENTION

Problem to be Solved by the Invention

According to the hydraulic pump control system described in Patent Document 1, an optimum maximum tilting amount is set on hydraulic actuator basis; therefore, in single operation of driving the hydraulic actuators respectively in a singular manner, an optimum maximum driving speed can be obtained on a hydraulic actuator basis.

However, in combined operation of simultaneously driving a plurality of hydraulic actuators, the delivery flow rate of the hydraulic pump is controlled according to a maximum value of maximum tilting amounts corresponding to the plurality of hydraulic actuators, and, therefore, a problem may be generated in which the delivery flow rate of the hydraulic pump becomes insufficient relative to the sum total of the required flow rates for the plurality of hydraulic actuators and, hence, an optimum maximum driving speed cannot be obtained on a hydraulic actuator basis. Here, it may be contemplated to cause the maximum tilting amount set on a hydraulic actuator basis to be greater than the optimum maximum tilting amount, so as to solve the problem of insufficiency of the delivery flow rate of the hydraulic pump at the time of combined operation. However, in the case of driving the hydraulic actuators respectively singularly under such setting, there is generated a problem in which the delivery flow rate of the hydraulic pump would be excessive in relation to the required flow rate for the hydraulic actuator, and energy loss would be enlarged.

The present invention has been made in consideration of the above-mentioned problems. It is an object of the present invention to provide a construction machine capable of driving hydraulic actuators respectively at suitable speeds while suppressing delivery flow rate of a hydraulic pump, both at single operation time of driving a plurality of hydraulic actuators respectively in a singular manner and at combined operation time of simultaneously driving the plurality of hydraulic actuators.

Means for Solving the Problem

In order to achieve the above object, according to the present invention, there is provided a construction machine including: a hydraulic pump of variable displacement type; a regulator that regulates displacement volume of the hydraulic pump; a plurality of hydraulic actuators driven by a hydraulic fluid delivered from the hydraulic pump; a plurality of flow control valves that control supply and discharge of the hydraulic fluid to and from the plurality of hydraulic actuators; a plurality of operation devices for operating the plurality of flow control valves; an operation amount sensor that detects each of operation amounts of the plurality of operation devices; and a controller that controls the regulator according to each of operation amounts of the plurality of operation devices detected by the operation amount sensor. The controller is configured to compute a first target displacement volume for each of operation amounts of the plurality of operation devices, compute a second target displacement volume greater than the first target displacement volume for the same operation amount, for each of operation amounts of the plurality of operation devices, select as a final target displacement volume either smaller one of a sum total value of a plurality of first target displacement volumes computed for the operation amounts of the plurality of operation devices and a maximum value of a plurality of second target displacement amounts computed for the operation amounts of the plurality of operation devices, and control the regulator according to the final target displacement volume.

According to the present invention configured as above, at the single operation time of driving the hydraulic actuators respectively singularly, the displacement volume of the hydraulic pump is regulated such as to coincide with the displacement volume (first displacement volume) set on a hydraulic actuator basis. Therefore, the hydraulic actuators can be driven respectively at suitable speeds, without causing the delivery flow rate of the hydraulic pump to be excessive.

In addition, at the combined operation time of simultaneously driving a plurality of hydraulic actuators, the displacement volume of the hydraulic pump is controlled such as to coincide with either smaller one (final target displacement volume) of the sum total value of the plurality of first displacement volumes computed for the operation amounts and a maximum value of the plurality of second displacement volumes computed for the operation amounts. Therefore, the plurality of hydraulic actuators can be driven respectively at suitable speeds, without causing the delivery flow rate of the hydraulic pump to be excessive.

As a result, both at the single operation time of driving the hydraulic actuators respectively in a singular manner and at the combined operation time of simultaneously driving the plurality of hydraulic actuators, the hydraulic actuators can be driven respectively at suitable speeds, while suppressing the delivery flow rate of the hydraulic pump.

Advantages of the Invention

According to the present invention, both in the single operation of driving the hydraulic actuators respectively in a singular manner and in the combined operation of simultaneously driving the plurality of hydraulic actuators, the hydraulic actuators can be driven respectively at suitable speeds while suppressing the delivery flow rate of the hydraulic pump.

MODE FOR CARRYING OUT THE INVENTION

Figure 1:
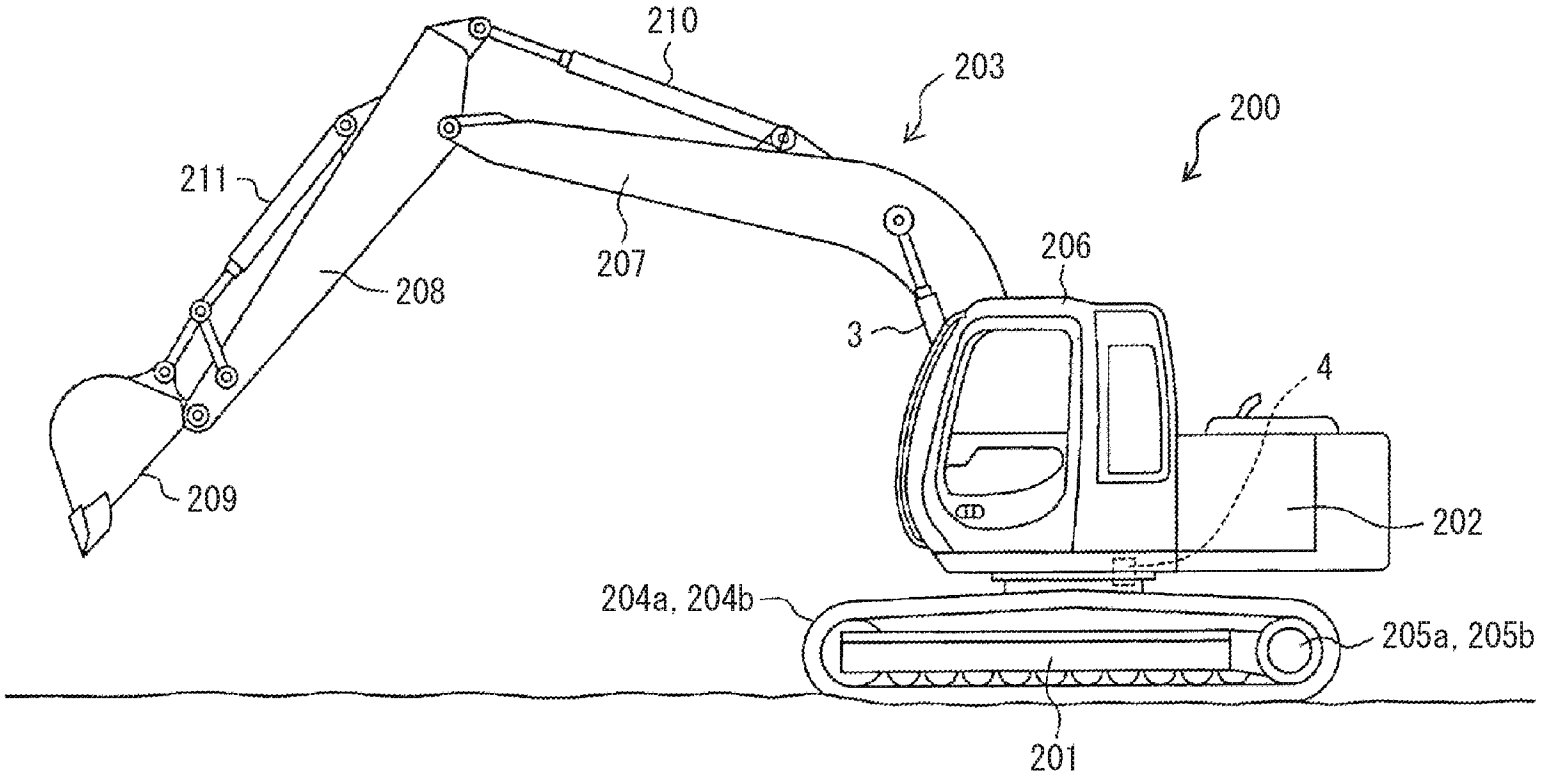
FIG. 1 is a side view of a hydraulic excavator as an example of a construction machine according to an embodiment of the present invention.

A hydraulic excavator taken as an example of a construction machine according to an embodiment of the present invention will be described below, referring to the drawings. Note that in the drawings the same or equivalent members are denoted by the same reference characters, and repeated descriptions of them will be appropriately omitted.

FIG. 1 is a side view of the hydraulic excavator according to the embodiment of the present invention.

In FIG. 1, a hydraulic excavator 200 includes a lower track structure 201, an upper swing structure 202, and a front work implement 203. The lower track structure 201 includes left and right crawler type track devices 204*a* and 204*b* (only one side is illustrated) which are driven by left and right track motors 205*a* and 205*b* (only one side is illustrated). The upper swing structure 202 is swingably mounted on the lower track structure 201 and driven to swing by a swing motor 4. The front work implement 203 is vertically rotatably mounted to a front portion of the upper swing structure 202. The upper swing structure 202 is provided with a cabin (operation room) 206, and operation devices such as operation lever devices 7 and 8 (see FIG. 2) to be described later and a track operation pedal device not illustrated are disposed inside the cabin 206.

The front work implement 203 includes: a boom 207 vertically rotatably mounted to a front portion of the upper swing structure 202; an arm 208 linked to a tip portion of the boom 2 in a vertically and front-rear-directionally rotatable manner; a bucket 209 linked to a tip portion of the arm 208 in a vertically and front-rear-directionally rotatable manner; a boom cylinder 3 as a hydraulic actuator for driving the boom 207; an arm cylinder 210 as a hydraulic actuator for driving the arm 208; and a bucket cylinder 211 as a hydraulic actuator for driving the bucket 209. The boom 207 is rotated vertically relative to the upper swing structure 202 by contraction and extension of the boom cylinder 3, the arm 208 is rotated vertically and front-rear-directionally relative to the boom 207 by contraction and extension of the arm cylinder 210, and the bucket 209 is rotated vertically and front-rear-directionally relative to the arm 208 by contraction and extension of the bucket cylinder 211.

Figure 2:
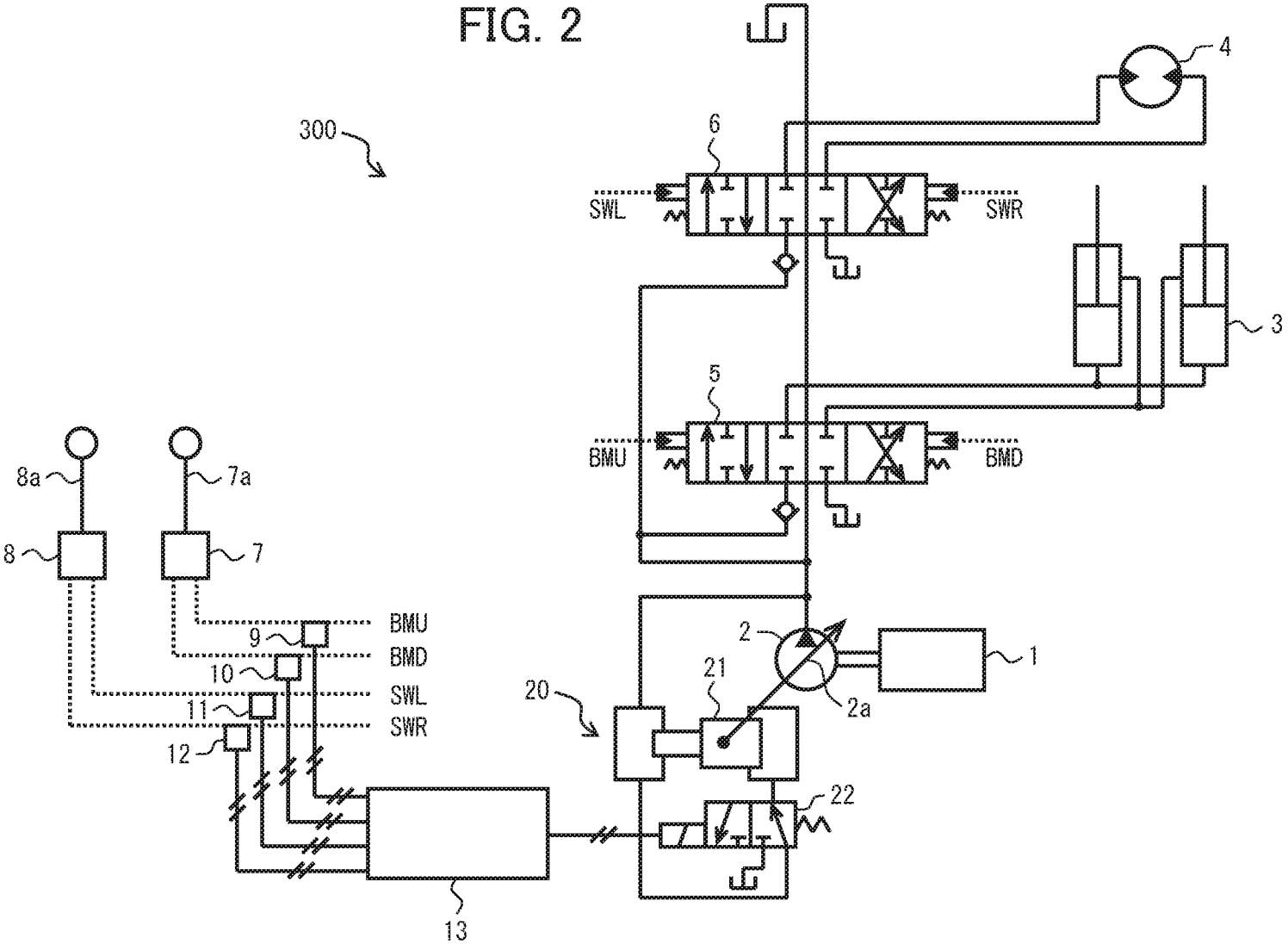
FIG. 2 is a schematic configuration diagram of a hydraulic drive system in the embodiment of the present invention.

FIG. 2 is a schematic configuration diagram of a hydraulic drive system mounted on the hydraulic excavator 200 illustrated in FIG. 1. Note that for simplification of explanation, in FIG. 2, only parts concerning driving of the boom cylinder 3 and the swing motor 4 are illustrated, and parts concerning driving of other hydraulic actuators are omitted.

In FIG. 2, the hydraulic drive system 300 includes an engine 1 as a prime mover, a variable displacement hydraulic pump 2 driven by the engine 1, the boom cylinder 3, the swing motor 4, a boom flow control valve 5 that controls supply and discharge of a hydraulic fluid to and from the boom cylinder 3, a swing flow control valve 6 that controls supply and discharge of a hydraulic fluid to and from the swing motor 4, a pilot-type boom operation lever device 7 that instructs an operation of the boom cylinder 3, a pilot-type swing operation lever device 8 that instructs an operation of the swing motor 4, a regulator 20 that regulates tilting of a displacement varying member (swash plate) 2*a* possessed by the hydraulic pump 2, and a controller 13 that controls the regulator 20.

The regulator 20 includes a tilting control piston 21 that drives the displacement varying member (swash plate) 2*a*, and a proportional solenoid valve 22 that produces an operation pressure for the tilting control piston 21 according to a command current inputted from the controller 13.

The boom flow control valve 5 is driven in the rightward direction in the figure by a pilot pressure (boom raising pilot pressure BMU) outputted from the boom operation lever device 7 when an operation lever (boom operation lever) 7*a* of the boom operation lever device 7 is operated to the boom raising side. As a result, an oil delivered from the hydraulic pump 2 is supplied to the bottom side of the boom cylinder 3, an oil discharged from the rod side of the boom cylinder 3 is returned to a tank, and the boom cylinder 3 performs an extending operation.

In addition, the boom flow control valve 5 is driven in the leftward direction in the figure by a pilot pressure (boom lowering pilot pressure BMD) outputted from the boom operation lever device 7 when the boom operation lever 7*a* is operated to the boom lowering side. As a result, an oil delivered from the hydraulic pump 2 is supplied to the rod side of the boom cylinder 3, an oil discharged from the bottom side of the boom cylinder 3 is returned to a tank, and the boom cylinder 3 performs a contracting operation.

The swing flow control valve 6 is driven in the rightward direction in the figure by a pilot pressure (swing left pilot pressure SWL) outputted from the swing operation lever device 8 when the operation lever (swing operation lever) 8*a* of the swing operation lever device 8 is operated to the swing left side. As a result, the hydraulic fluid delivered from the hydraulic pump 2 is supplied to a port on the left side in the figure of the swing motor 4, the oil discharged from a port on the right side in the figure of the swing motor 4 is returned to the tank, and the swing motor 4 is rotated in a left swing direction.

Besides, the swing flow control valve 6 is driven in the leftward direction in the figure by a pilot pressure (swing right pilot pressure SWR) outputted from the swing operation lever device 8 when the swing operation lever 8*a* is operated to the swing right side. As a result, the hydraulic fluid delivered from the hydraulic pump 2 is supplied to the port on the right side in the figure of the swing motor 4, the oil discharged from the port on the left side in the figure of the swing motor 4 is returned to the tank, and the swing motor 4 is rotated in a right swing direction.

A pilot line that guides the boom raising pilot pressure BMU outputted from the boom operation lever device 7 to an operation section on the left side in the figure of the boom flow control valve 5 is provided with a pressure sensor 9 that detects the boom raising pilot pressure BMU. A pilot line that guides the boom lowering pilot pressure BMD outputted from the boom operation lever device 7 to an operation section on the right side in the figure of the boom flow control valve 5 is provided with a pressure sensor 10 that detects the boom lowering pilot pressure BMD.

A pilot line that guides the swing left pilot pressure SWL outputted from the swing operation lever device 8 to an operation section on the left side in the figure of the swing flow control valve 6 is provided with a pressure sensor 11 that detects the swing left pilot pressure SWL. A pilot line that guides the swing right pilot pressure SWR outputted from the swing operation lever device 8 to an operation section on the right side in the figure of the swing flow control valve 6 is provided with a pressure sensor 12 that detects the swing right pilot pressure SWR.

The controller 13 receives inputs of detection signals (pilot pressures) from the pressure sensors 9, 10, 11 and 12, performs predetermined calculation processing, and outputs a command current to the proportional solenoid valve 22 of the regulator 20.

Figure 3:
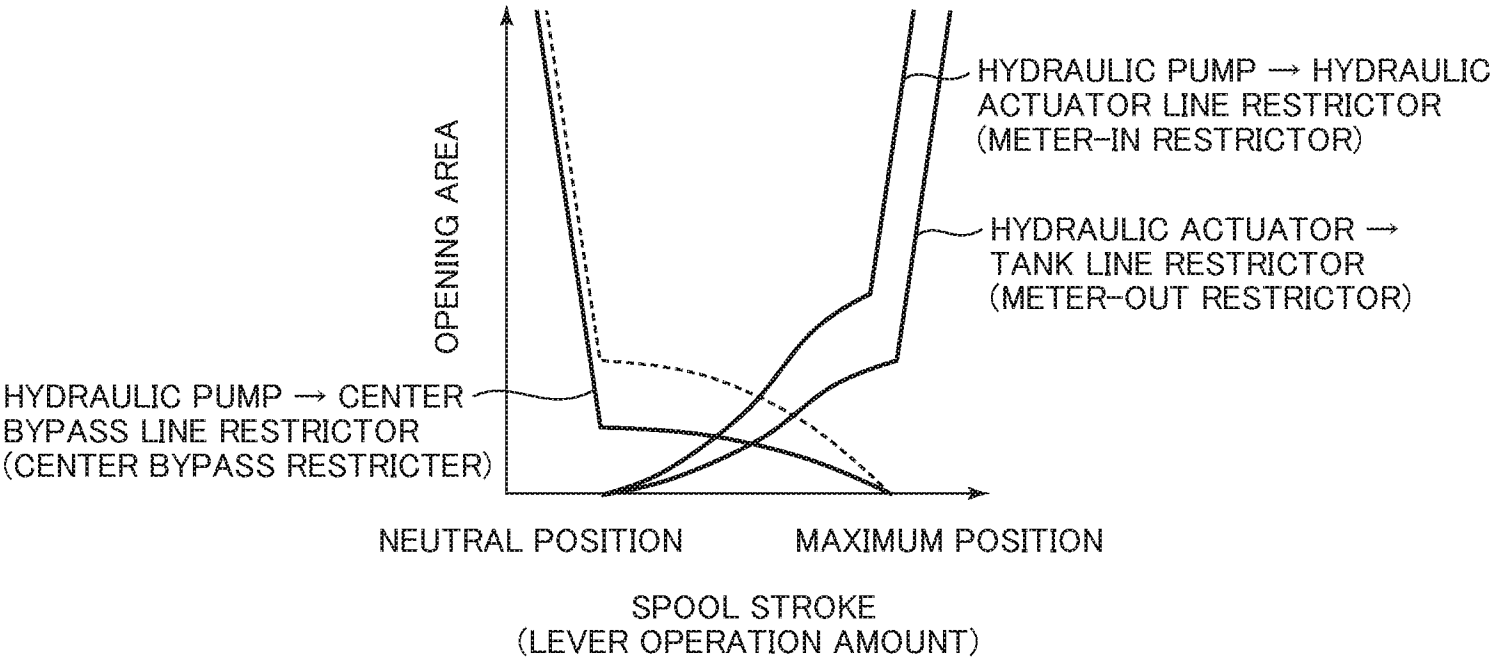
FIG. 3 is a diagram schematically depicting a relation between a spool stroke (pilot pressure) of a flow control valve and an opening area of each restrictor.

A hydraulic circuit depicted in FIG. 2 is of a system called open center type. In this system, relations between strokes of spools of the flow control valves 5 and 6 and an opening area of each restrictor are set as depicted in FIG. 3, whereby the flow rates of a hydraulic fluid supplied from the hydraulic pump 2 to the hydraulic actuators 3 and 4 (hereinafter referred to as meter-in flow rates) and the flow rate of a hydraulic fluid returned from the hydraulic pump 2 to the tank through a center bypass line (hereinafter referred to as bleed-off flow rate) are controlled according to the strokes of the spools, that is, the operation amounts (lever operation amounts) of the operation levers 7*a* and 8*a*.

For example, in a case where the operation levers 7*a* and 8*a* are in neutral positions, only a center bypass restrictor is open, and, therefore, all the hydraulic fluid is returned to the tank. In a case where the operation levers 7*a* and 8*a* are in intermediate positions, both the center bypass restrictor and a meter-in restrictor are open, and, therefore, part of the hydraulic fluid is returned to the tank, while the remainder of the hydraulic fluid is supplied to the hydraulic actuators 3 and 4. In a case where the operation levers 7*a* and 8*a* are in maximum positions, only the meter-in restrictor is open, and, therefore, all the hydraulic fluid is supplied to the hydraulic actuators 3 and 4.

Figure 4:
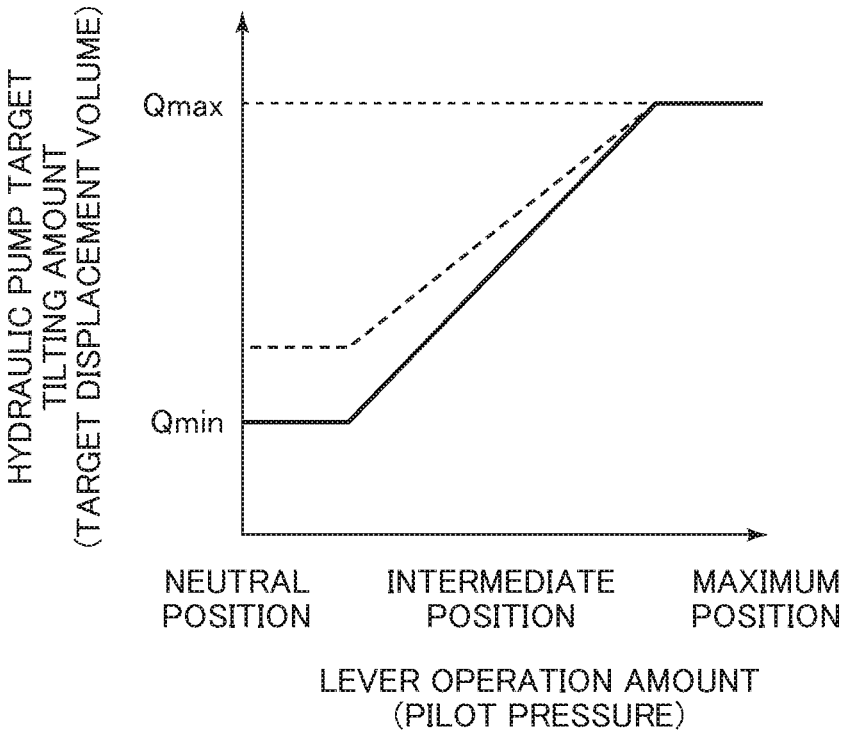
FIG. 4 is a diagram schematically depicting a relation between a lever operation amount (pilot pressure) and a target tilting amount (target displacement volume) of a hydraulic pump in the prior art.

In the case where the opening areas of center bypass restrictors of the boom flow control valve 5 and the swing flow control valve 6 are comparatively large (broken line in FIG. 3), a bleed-off flow rate at an intermediate position is also comparatively large. In the prior art, therefore, target tilting amount characteristics for boom and swing operation amounts are set to be comparatively large (broken line in FIG. 4).

Here, a case where the boom flow control valve 5 and the swing flow control valve 6 are simultaneously operated respectively at intermediate positions (hereinafter referred to as combined operation) is assumed. When the center bypass restrictors of the boom flow control valve 5 and the swing flow control valve 6 are deemed as series restrictors, the equivalent opening area is small as compared to a case where the boom flow control valve 5 or the swing flow control valve 6 is singularly operated (hereinafter referred to single operation), and, therefore, a bleed-off flow rate is also reduced. As a result, the flow rates of the hydraulic fluid supplied to the hydraulic actuators 3 and 4 are increased, and the hydraulic actuators 3 and 4 can be driven respectively at suitable speeds.

On the other hand, in a case where the opening areas of the center bypass restrictors of the boom flow control valve 5 and the swing flow control valve 6 are comparatively small (solid line in FIG. 3), a bleed-off flow rate at an intermediate position is comparatively small. In the prior art, therefore, target tilting amount characteristics for boom and swing operation amounts are set to be comparatively small (solid line in FIG. 4). Such a setting may be made, for example, for the purpose of reducing the loss due to the bleed-off flow rate.

In this case, when the boom flow control valve 5 and the swing flow control valve 6 are put into combined operation respectively at intermediate positions, the bleed-off flow rate is reduced as compared to the case of single operation, like in a case where the opening areas of the center bypass restrictors are comparatively large, but the reduction amount is decreased. Therefore, the flow rates of the hydraulic fluid supplied to the hydraulic actuators 3 and 4 may not be sufficiently increased, and it may be impossible to drive the hydraulic actuators 3 and 4 at suitable speeds. In the present embodiment, the controller 13 has the functions as described below, whereby the hydraulic actuators 3 and 4 can be driven respectively at suitable speeds while suppressing the delivery flow rate of the hydraulic pump 2, both at the single operation time of driving the plurality of hydraulic actuators 3 and 4 respectively singularly and at the combined operation time of simultaneously driving the plurality of hydraulic actuators 3 and 4.

Figure 5:
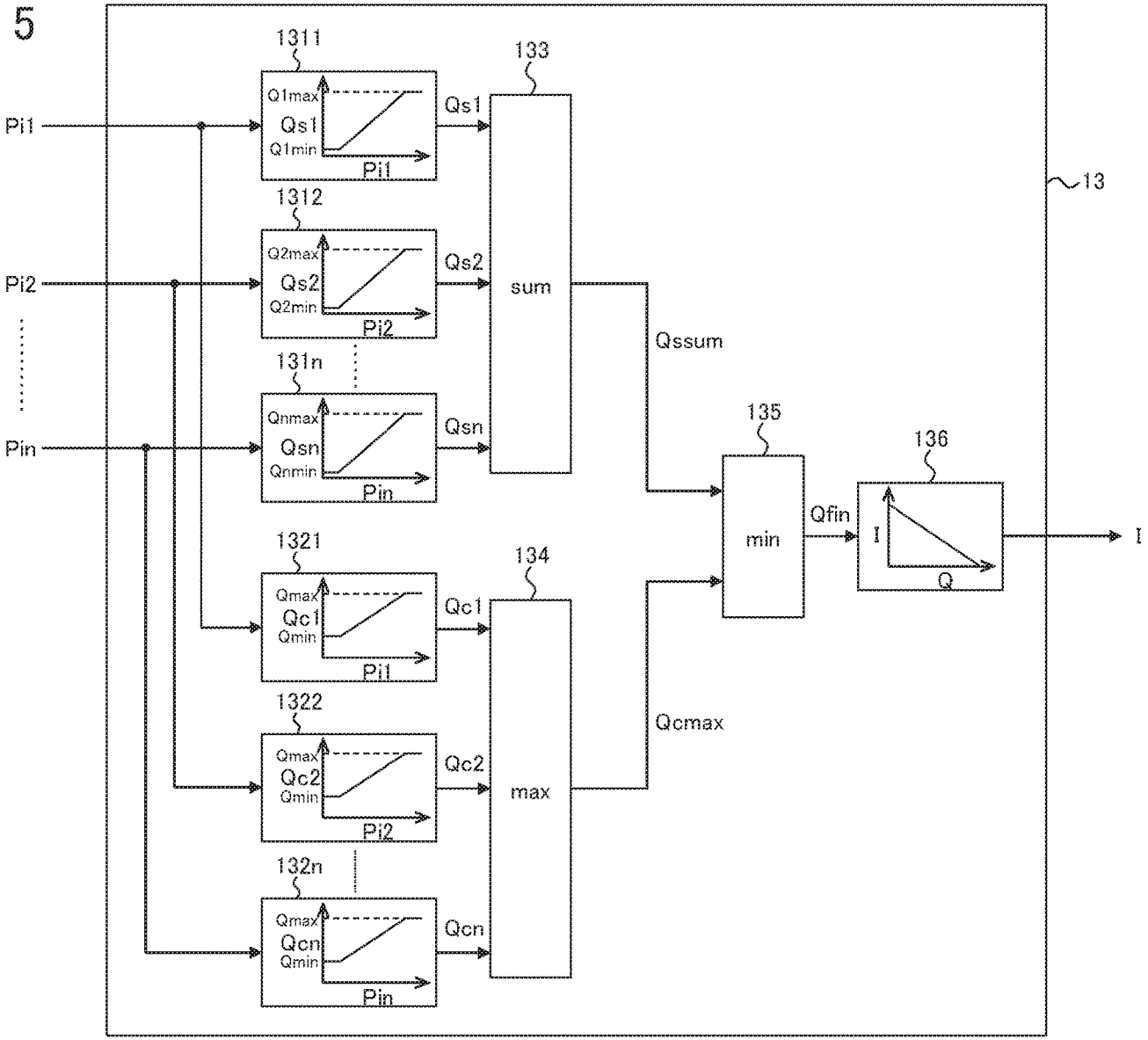
FIG. 5 is a functional block diagram of a controller in the embodiment of the present invention.

FIG. 5 is a functional block diagram of the controller 13.

In FIG. 5, the controller 13 includes first displacement volume conversion sections 1311, 1312, 131*n*, second displacement volume conversion sections 1321, 1322, 132*n*, an addition section 133, a maximum value selection section 134, a minimum value selection section 135, and a command current conversion section 136.

The first displacement volume conversion section 1311 and the second displacement volume conversion section 1321 store a target displacement volume characteristic of the hydraulic pump 2 for a pilot pressure Pi1 (lever operation amount), convert the inputted pilot pressure Pi1 respectively into a first displacement volume Qs1 and a second displacement volume Qc1, and output them. The first displacement volume conversion section 1312 and the second displacement volume conversion section 1322 store a target displacement volume characteristic of the hydraulic pump 2 for a pilot pressure Pi2 (lever operation amount), convert the inputted pilot pressure Pi2 respectively into a first displacement volume Qs2 and a second displacement volume Qc2, and output them. The first displacement volume conversion section 131*n* and the second displacement volume conversion section 132*n* store a target displacement volume characteristic of the hydraulic pump 2 for other pilot pressure Pin (lever operation amount), convert the inputted pilot pressure Pin respectively into a first displacement volume Qsn and a second displacement volume Qcn, and output them. Hereinafter, description will be made by taking the pilot pressure Pi1 as the boom raising pilot pressure BMU, and taking the pilot pressure Pi2 as the swing left pilot pressure SWL.

The addition section 133 outputs a sum total value Qssum of output values Qs1, Qs2, . . . , Qsn of the first target displacement volume conversion sections 1311, 1312, . . . , 131*n*.

The maximum value selection section 134 selects and outputs a maximum value Qcmax of output values Qc1, Qc2, . . . , Qcn of the second target displacement volume conversion sections 1321, 1322, . . . , 132*n*.

The minimum value selection section 135 selects either smaller one of the output value Qssum of the addition section 133 and the output value Qcmax of the maximum value selection section 134, and outputs the selected value as a final target displacement volume Qfin.

The command current conversion section 136 outputs a command current I according to the final target displacement volume Qfin outputted from the minimum value selection section 135, to the proportional solenoid valve 22 of the regulator 20.

Figure 6:
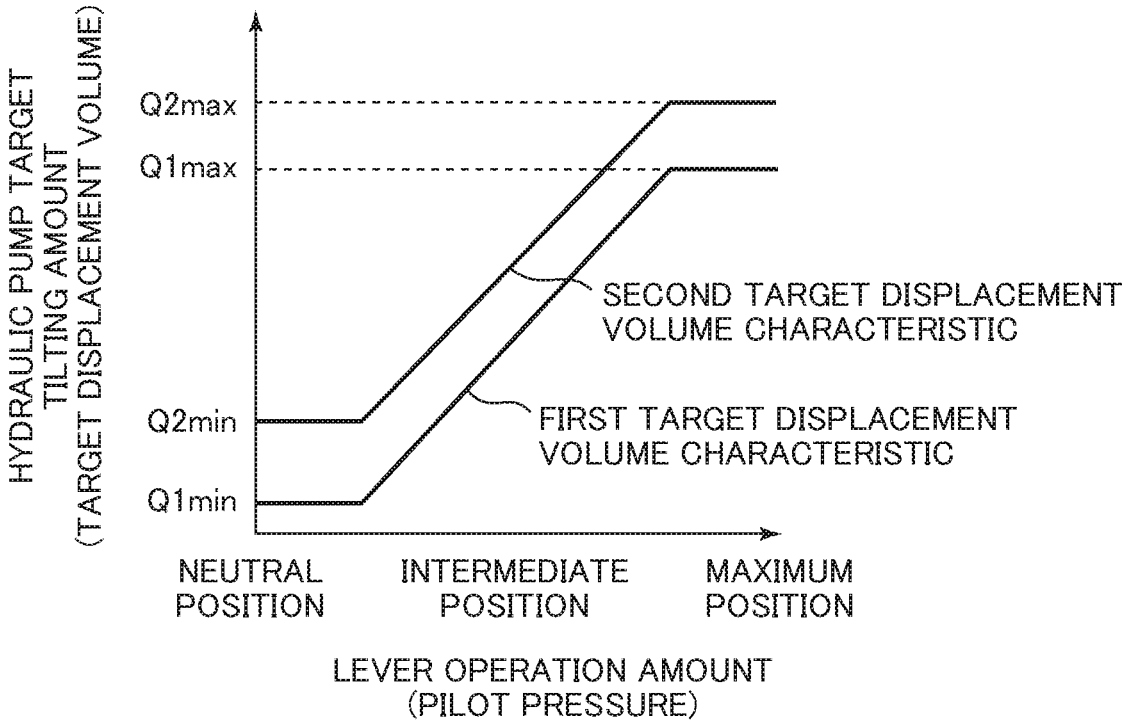
FIG. 6 is a diagram schematically depicting a relation between a lever operation amount (pilot pressure) and a target tilting amount (target displacement volume) of a hydraulic pump in the embodiment of the present invention.

FIG. 6 depicts a relation between the target displacement volume characteristic (first target displacement volume characteristic) stored in the first target displacement volume conversion sections 1311, 1312, . . . , 131*n* and the target displacement volume characteristic (second target displacement volume characteristic) stored in the second target displacement volume conversion sections 1321, 1322, . . . , 132*n*.

As depicted in FIG. 6, the first and second target displacement volumes are both increased according to the lever operation amount (pilot pressure). A maximum value Q2max of the second target displacement volume is set to be equivalent to a maximum displacement volume of the hydraulic pump 2. A minimum value Q2min of the second target displacement volume is set to be equivalent to a minimum displacement volume of the hydraulic pump 2. A maximum value Q1max of the first target displacement volume is set to be equal to or lower than the maximum value Q2max of the second target displacement volume. Here, maximum values Q1max, Q2max, . . . , Q1max of the first target displacement volumes Qs1, Qs2, . . . , Qsn are desirably set according to required maximum speeds of the plurality of hydraulic actuators 3 and 4. As a result, it is possible to suppress delivery flow rate of the hydraulic pump 2 and suppress energy loss, while driving the hydraulic actuators 3 and 4 at maximum required speeds when each of the hydraulic actuators 3 and 4 is put into full-lever operation in a singular manner.

A minimum value Q1min of the first target displacement volume is set at approximately 1/n times a minimum value Q1min of the second target displacement volumes Qc1, Qc2, . . . , Qcn. As a result, when all the operation levers are located in neutral positions, the sum total value outputted from the addition section 133 is equal to the minimum value Qmin of the values outputted from the second target displacement volume conversion sections 1321, 1322, . . . , 132*n*, so that the final target displacement volume Qfin outputted from the minimum value selection section 135 can be made to coincide with the minimum displacement volume Qmin.

An operation of the hydraulic drive system 300 in the present embodiment will be described below.

When an operator of the hydraulic excavator 200 operates the boom operation lever 7*a* at an intermediate position in the direction for extending the boom cylinder 3, a pilot pressure acts on a pressure receiving part on the left side of the boom flow control valve 5, and the boom flow control valve 5 is moved toward the right side in the figure. In this instance, the boom raising pilot pressure BMU is detected by the pressure sensor 9, and a detection signal is inputted as Pi1 to the controller 13.

In the controller 13, the first target displacement volume Qs1 according to the pilot pressure Pi1 is outputted from the first target displacement volume conversion section 1311, and, on the other hand, no other hydraulic actuator than the boom cylinder 3 is operated, so that the first target displacement volume Qs1 is outputted as it is from the addition section 133. In addition, the second target displacement volume Qc1 according to the pilot pressure Pi1 is outputted also from the second target displacement volume conversion section 1321, while the minimum value Qmin of the second target displacement volume is outputted from the other second target displacement volume conversion sections 1322, 132*n*, whereby the second target displacement volume Qc1 is selected in the maximum value selection section 134. Since the first target displacement volume Qs1 is set to be smaller where the operation amount is at an intermediate position, the first target displacement volume Qs1 is selected in the minimum value selection section 135, and a command current I according to this is outputted from the command current conversion section 136 to the proportional solenoid valve 22 of the regulator 20.

Similarly, when the swing operation lever 8*a* is operated at an intermediate position in the left swing direction, the first target displacement volume Qs2 is selected in the minimum value selection section 135 according to the detection signal Pi2 at the pressure sensor 11.

On the other hand, when the operator of the hydraulic excavator 200 put the operation levers 7*a* and 8*a* into combined operation respectively at intermediate positions and rotates the swing motor 4 in the left swing direction while extending the boom cylinder 3, detection signals Pi1 and Pi2 at the pressure sensors 9 and 11 are inputted to the controller 13.

In the controller 13, the first target displacement volumes Qs1 and Qs2 according to the pilot pressures Pi1 and Pi2 are outputted respectively from the first target displacement volume conversion sections 1311 and 1312, whereby an added value Qs1+Qs2 of these is outputted from the addition section 133. In addition, the second target displacement volumes Qc1 and Qc2 according to the pilot pressures Pi1 and Pi2 are respectively outputted also from the second target displacement volume conversion sections 1321 and 1322, and, therefore, a maximum value of these is selected in the maximum value selection section 134. Accordingly, in the minimum value selection section 135, the added value of Qs1+Qs2 of the target displacement volumes and the maximum value of the target displacement volumes Qc1 and Qc2 are compared with each other, and the minimum value of them is selected. As a result, the flow rates of the hydraulic fluid supplied to the hydraulic actuators can be set according to the combination of the hydraulic actuators put into combined operation and the operation amounts.

Figure 7:
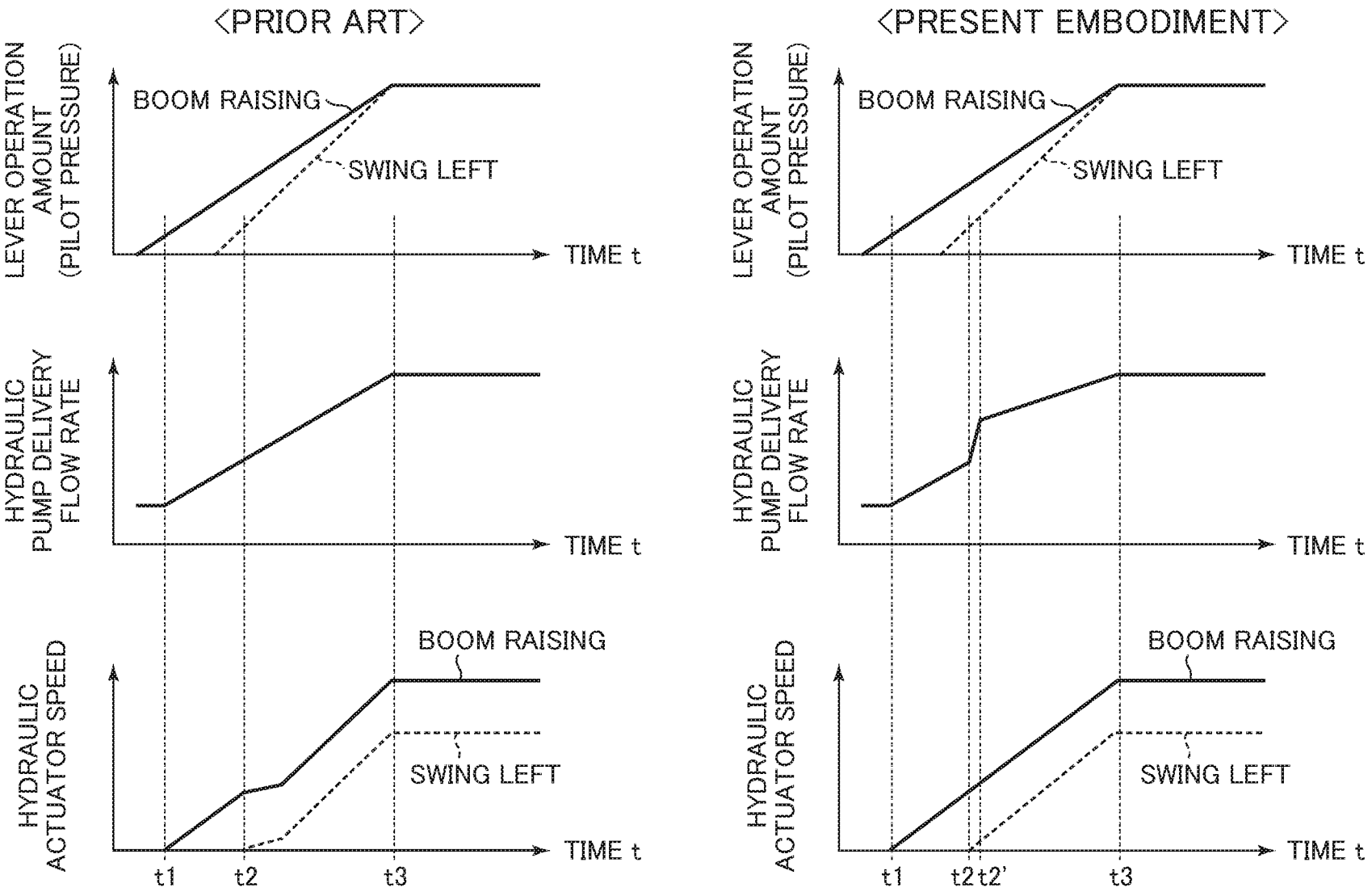
FIG. 7 includes diagrams depicting variations in lever operation amount, hydraulic pump delivery flow rate, and hydraulic actuator speed in a case where a swing left operation is conducted during a single operation of boom raising, in a hydraulic drive system according to the embodiment of the present invention, in comparison with the prior art.

FIG. 7 includes diagrams depicting variations in lever operation amount, hydraulic pump delivery flow rate, and hydraulic actuator speed in a case where a swing left operation is conducted during a boom raising single operation, in the hydraulic drive system 300 according to the present embodiment, in comparison with the prior art.

As depicted in FIG. 7, while the boom raising operation is being conducted in a singular manner (time t1 to t2), the boom cylinder 3 is extended at a speed according to the lever operation amount (pilot Pi1), both in the prior art and in the present embodiment.

When a swing left operation is performed during a boom raising operation (time t2 to t3), in the prior art, the delivery flow rate of the hydraulic pump 2 is distributed to the boom cylinder 3 and the swing motor 4, whereby the speed of the boom cylinder 3 is lower than a speed according to the lever operation amount. In addition, since a sufficient flow rate is not distributed to the swing motor 4, the speed of the swing motor 4 is lower than a speed according to the lever operation amount.

On the other hand, in the present embodiment, when a swing left operation is conducted during a boom raising operation (time t2 to t3), the delivery flow rate of the hydraulic pump 2 coincides with a sum total value Qssum of the first displacement volume Qs1 according to the operation amount of the boom operation lever 7*a* and the first displacement volume Qs2 according to the operation amount of the swing operation lever 8*a* during when the lever operation amount of the swing left operation is small (time t2 to t2'). In addition, when the lever operation amount of the swing left operation is enlarged (time t2' to t3), the delivery flow rate of the hydraulic pump 2 coincides with a maximum value Qcmax of the second displacement volume Qc1 according to the operation amount of the boom operation lever 7*a* and the second displacement volume Qc2 according to the operation amount of the swing operation lever 8*a*. As a result, the delivery flow rate of the hydraulic pump 2 is increased, as compared to the prior art. Accordingly, at the time of combined operation of boom raising and swing left, the swing motor 4 can be driven according to the operation amount of the swing operation lever 8*a* while driving the boom cylinder 3 at a speed according to the operation amount of the boom operation lever 7*a*.

In this way, the hydraulic excavator 200 according to the present embodiment includes: the hydraulic pump 2 of variable displacement type; the regulator 20 that regulates the displacement volume of the hydraulic pump 2; the plurality of hydraulic actuators 3 and 4 driven by the hydraulic fluid delivered from the hydraulic pump 2; the plurality of flow control valves 5 and 6 that control the supply and discharge of the hydraulic fluid to and from the plurality of hydraulic actuators 3 and 4; the plurality of operation devices 7 and 8 for operating the plurality of flow control valves 5 and 6; the operation amount sensors 9, 10, 11 and 12 that detect the operation amounts of the plurality of operation devices 7 and 8; and the controller 13 that controls the regulator 20 according to the operation amounts of the plurality of operation devices 7 and 8 detected by the operation amount sensors 9, 10, 11 and 12. The controller 13 is configured to compute the first target displacement volumes Qs1, Qs2, . . . , Qsn for each of the operation amounts of the plurality of operation devices 7 and 8, compute the second target displacement volumes Qc1, Qc2, . . . , Qcn greater than the first target displacement volumes Qs1, Qs2, . . . , Qsn for the same operation amount for each of the operation amounts of the plurality of operation devices 7 and 8, select as the final target displacement volume Qfin either smaller one of the sum total value Qssum of the plurality of first target displacement volumes Qs1, Qs2, . . . , Qsn computed for the operation amounts of the plurality of operation devices 7 and 8 and the maximum value Qcmax of the plurality of second target displacement volumes Qc1, Qc2, . . . , Qcn computed for the operation amounts of the plurality of operation devices 7 and 8, and control the regulator 20 according to the final target displacement volume Qfin.

In addition, the regulator 20 includes the tilting control piston 21 that drives the displacement varying member (swash plate) 2*a*, and the proportional solenoid valve 22 that produces an operation pressure for the tilting control piston 21 according to a command current inputted from the controller 13. The controller 13 includes: the plurality of first displacement volume conversion sections 1311, 1312, . . . , 131*n* that convert the operation amounts of the plurality of operation devices 7 and 8 into the first target displacement volumes Qs1, Qs2, . . . , Qsn; the plurality of second displacement volume conversion sections 1321, 1322, . . . , 132*n* that convert the operation amounts of the plurality of operation devices 7 and 8 into the second target displacement volumes Qc1, Qc2, . . . , Qcn; the addition section 133 that computes the sum total value Qssum of the plurality of first target displacement values Qs1, Qs2, . . . , Qsn converted by the plurality of the first displacement volume conversion sections 1311, 1312, . . . , 131*n*; the maximum value selection section 134 that selects and outputs the maximum value Qcmax of the plurality of second target displacement volumes Qc1, Qc2, . . . , Qcn computed by the plurality of second displacement volume conversion sections 1321, 1322, . . . , 132*n*; the minimum value selection section 135 that selects either smaller one of the output value Qssum of the addition section 133 and the output value Qcmax of the maximum value selection section 134 and outputs the selected value as the final target displacement volume Qfin; and the command current conversion section 136 that outputs the command current I according to the output value Qfin of the minimum value selection section 135 to the proportional solenoid valve 22.

According to the hydraulic excavator 200 according to the present embodiment configured as above, at the single operation time of driving the hydraulic actuators 3 and 4 in a respectively singular manner, the displacement volume of the hydraulic pump 2 is regulated such as to coincide with the displacement volumes (first displacement volumes) Qs1, Qs2, . . . , Qsn set on the basis of each of the hydraulic actuators 3 and 4, and, therefore, the hydraulic actuators 3 and 4 can be driven at suitable speeds without causing the delivery flow rate of the hydraulic pump 2 to be excessive.

In addition, at the combined operation time of simultaneously driving the plurality of hydraulic actuators 3 and 4, the displacement volume of the hydraulic pump 2 is controlled such as to coincide with either smaller one (final target displacement volume Qfin) of the sum total value Qssum of the first displacement volumes Qs1, Qs2, . . . , Qsn computed for each lever operation amount and the maximum value Qcmax of the second displacement volumes Qc1, Qc2, . . . , Qcn computed for each lever operation amount, and, therefore, the plurality of hydraulic actuators 3 and 4 can be driven respectively at suitable speeds without causing the delivery flow rate of the hydraulic pump 2 to be excessive.

As a result, both at the single operation time of driving the hydraulic actuators 3 and 4 respectively in a singular manner and at the combined operation time of simultaneously driving the plurality of hydraulic actuators 3 and 4, the hydraulic actuators 3 and 4 can be driven respectively at suitable speeds while suppressing the delivery flow rate of the hydraulic pump 2.

Particularly, at the time of combined operation of operating the operation levers 7*a* and 8*a* respectively finely, the output value Qssum of the addition section 133 is lower than the output value Qcmax of the maximum value selection section 134, so that the output value Qssum of the addition section 133 is selected as the final target displacement volume Qfin, and, therefore, the hydraulic actuators 3 and 4 can be driven at speeds according to the lever operation amounts, while suppressing the delivery flow rate of the hydraulic pump to a required minimum value.

In addition, the maximum value of first required pump flow rates Q1max, Q2max, . . . , Qnmax at the plurality of first target displacement volume conversion sections 1311, 1312, 131*n* is set according to the required maximum speeds of the plurality of hydraulic actuators 3 and 4, whereby it is possible to suppress the delivery flow rate of the hydraulic pump 2 and to suppress the energy loss, while driving the hydraulic actuators 3 and 4 at maximum required speeds when each of the hydraulic actuators 3 and 4 is put into full-lever operation in a singular manner.

Note that the present invention is not limited to the above-described embodiment, but includes various modifications. For example, the above embodiment has been described in detail for explaining the present invention in an easily understandable manner, and the invention is not necessarily limited to the configuration that includes all the above-described components.

DESCRIPTION OF REFERENCE CHARACTERS

1: Engine (prime mover)
2: Hydraulic pump
2*a*: Displacement varying member (swash plate)
3: Boom cylinder
4: Swing motor
5: Boom flow control valve
6: Swing flow control valve
7: Boom operation lever device (operation device)
7*a*: Boom operation lever
8: Swing operation lever device (operation device)
8*a*: Swing operation lever
9, 10, 11, 12: Pressure sensor (operation amount sensor)
13: Controller
20: Regulator
21: Tilting control piston
22: Proportional solenoid valve
200: Hydraulic excavator (construction machine)
201: Lower track structure
202: Upper swing structure
203: Front work implement
204*a*, 204*b*: Crawler type track device
205*a*, 205*b*: Track motor
206: Cabin
207: Boom
208: Arm
209: Bucket
210: Arm cylinder
211: Bucket cylinder
300: Hydraulic drive system
1311, 1312, 131*n*: First target displacement volume conversion section
1321, 1322, 132*n*: Second target displacement volume conversion section
133: Addition section
134: Maximum value selection section
135: Minimum value selection section
136: Command current conversion section.

The invention claimed is:

1. A construction machine comprising:
a hydraulic pump of variable displacement type;
a regulator that regulates displacement volume of the hydraulic pump;
a plurality of hydraulic actuators driven by a hydraulic fluid delivered from the hydraulic pump;
a plurality of flow control valves that control supply and discharge of the hydraulic fluid to and from the plurality of hydraulic actuators;
a plurality of operation devices for operating the plurality of flow control valves;
a plurality of operation amount sensors that detect operation amounts of each of the plurality of operation devices; and
a controller that controls the regulator according to the plurality of operation amounts,
wherein the controller is configured to
compute a first target displacement volume for each of the plurality of operation amounts,
compute a second target displacement volume for each of the plurality of operation amounts, the second target displacement volumes are greater than a respective one of the first target displacement volumes,
compute a sum total value of the plurality of first target displacement volumes,
compute a maximum value of a plurality of second target displacement volumes,
select as a final target displacement volume a minimum of the sum total value of the plurality of first target displacement volumes and the maximum value of the plurality of second target displacement volumes, and
control the regulator according to the final target displacement volume.

2. The construction machine according to claim 1,
wherein the regulator includes a tilting control piston that drives a displacement varying member of the hydraulic pump, and a proportional solenoid valve that produces an operation pressure for the tilting control piston according to a command current inputted from the controller, and
the controller includes
a plurality of first displacement volume conversion sections that convert the plurality of operation amounts of the plurality of operation devices into the plurality of first target displacement volumes,
a plurality of second displacement volume conversion sections that convert the plurality of operation amounts of the plurality of operation devices into the plurality of second target displacement volumes,
an addition section that computes the sum total value of the plurality of first target displacement volumes converted by the plurality of first displacement volume conversion sections, a maximum value selection section that selects and outputs the maximum value of the plurality of second target displacement volumes computed by the plurality of second displacement volume conversion sections, a minimum value selection section that selects the minimum of the sum total computed by the addition section and the maximum value computed by the maximum value selection section, and outputs the final target displacement volume, and a command current conversion section that outputs a command current, according to the final target displacement volume computed by the minimum value selection section, to the proportional solenoid valve.

3. The construction machine according to claim 1, wherein the plurality of hydraulic actuators each have a required maximum speed, where each of the plurality of first target displacement volumes have a maximum first target displacement value, wherein each of the maximum first target displacement values of the first target displacement volumes is set according to a respective one of the required maximum speeds of the plurality of hydraulic actuators.

* * * * *